US009601012B2

(12) United States Patent
Williams

(10) Patent No.: US 9,601,012 B2
(45) Date of Patent: Mar. 21, 2017

(54) REMOTE OPERATED SAFETY ATTENDANT

(71) Applicant: John Williams, Springfield, MO (US)

(72) Inventor: John Williams, Springfield, MO (US)

( * ) Notice: Subject to any disclaimer, the term of this patent is extended or adjusted under 35 U.S.C. 154(b) by 87 days.

(21) Appl. No.: 13/622,871

(22) Filed: Sep. 19, 2012

(65) Prior Publication Data

US 2013/0106619 A1 May 2, 2013

Related U.S. Application Data

(60) Provisional application No. 61/537,925, filed on Sep. 22, 2011.

(51) Int. Cl.
*G08G 1/0955* (2006.01)
*G08G 1/07* (2006.01)

(52) U.S. Cl.
CPC ..... *G08G 1/07* (2013.01); *G08G 1/0955* (2013.01)

(58) Field of Classification Search
CPC ..... G08G 1/0955; B60Q 7/00; E01F 9/0118; E01F 9/0165
USPC .... 340/908, 907, 473; 116/63 P, 63 R, 63 C, 116/63 T; 40/607.01, 607.1
See application file for complete search history.

(56) References Cited

U.S. PATENT DOCUMENTS 2,829,362 A 4/1958 Terrill
3,046,521 A 7/1962 Cantwell et al.
3,867,718 A 2/1975 Moe
4,052,067 A 10/1977 Carmo
4,200,906 A * 4/1980 Santilli ..... F21V 21/116 248/158
4,613,847 A 9/1986 Scolari et al.
4,772,869 A * 9/1988 Grammas et al. ..... 116/63 C
5,061,921 A 10/1991 Lesko et al.
5,422,638 A 6/1995 Singer et al.
5,577,824 A * 11/1996 Wright ..... 340/908.1
5,959,554 A 9/1999 Armstrong et al.
6,052,067 A * 4/2000 Nuxoll ..... G08G 1/0955 340/908
6,104,313 A 8/2000 Boyd, II
6,150,957 A 11/2000 Henz et al.
6,448,905 B1 * 9/2002 Jones ..... 340/907
7,902,998 B2 3/2011 Wheaton
2011/0199231 A1 * 8/2011 Loiselle ..... G09F 9/33 340/907

* cited by examiner

*Primary Examiner* — Andrew Bee

(74) *Attorney, Agent, or Firm* — Lathrop & Gage LLP

(57) ABSTRACT

A remote operated safety attendant having a substantially pyramidic housing made of high impact material such as manufactured dense fiber. A two sided sign is mounted to a shaft positioned within the housing and connected to a drive motor and a remote signal receiver. A remote signal sender is used to send signals to the receiver to selectively actuate the drive mechanism which rotates to alternately display the opposed sides of the sign. The device meets requisite traffic safety requirements and allows an operator to remotely control the device to remain out of the pathway of vehicles that they are controlling through the signaling device.

8 Claims, 5 Drawing Sheets

REMOTE OPERATED SAFETY ATTENDANT

RELATED APPLICATION

This application claims the benefit of U.S. Provisional Patent Application 61/537,925 filed Sep. 22, 2011, the entire contents of which are incorporated herein by reference.

FIELD OF THE INVENTION

The present invention relates to a remote controlled traffic signal system which allows an operator to alternate the orientation of a traffic sign from a remote location wherein the device is easy to use, durable, and meets Test Level 3 of the American Association of State Highway and Transportation Officials' "Manual for Assessing Safety Hardware" evaluation criteria.

BACKGROUND OF THE INVENTION

Traffic control signals have been used since the advent of motorized vehicles. A common use of traffic control signals relates to directing traffic flow patterns in construction or work zones, at blocked or partially blocked roadways, at scenes of vehicle emergencies and accidents and the like. The most common practice utilized is for a worker to stand on or near a roadway to manually control traffic patterns by the use of signs. Common practice includes the use of a two-sided paddle sign, one side displaying STOP and second sign displaying SLOW, where the worker alternates the side of the sign displayed to oncoming traffic to advise motorists to either decrease their speed or to come to a full stop.

In practice, it is common for two workers to be present and spaced apart to direct traffic traveling in opposing directions, for example on a two lane roadway. For example, where one lane of a two lane road is closed, a worker at each end of the second of closed roadway may alternate slowing and stopping vehicles so that traffic traveling in both directions alternate use of the open or available traffic lane.

Over the years, numerous efforts have been made to improve traffic signaling and the safety of traffic workers. Traffic control workers have an incredibly dangerous job and are often struck by vehicles who fail to heed the warnings or signs the worker is presenting. In fact, traffic control workers have one of the most dangerous public safety jobs with a resultant number of injuries and fatalities on an annual basis exceeding the total number of injuries and fatalities of policemen and firefighters combined.

Efforts to increase the safety for traffic control workers includes the utilization of lighted and flashing signage, bright and fluorescent colored clothing and hard hats, the use of temporary blockades or physical barriers, and working traffic from control vehicles, sometimes known in the industry as "lead cars." Despite these efforts, numerous traffic control workers are injured and killed every year.

These problems have been addressed many times in earlier patents and there are several references that discuss, disclose and claim remotely controlled traffic control systems. These include U.S. Pat. No. 7,902,998 to Wheaton, U.S. Pat. No. 3,867,718 to Moe, U.S. Pat. No. 2,829,362 to Terrill, U.S. Pat. No. 6,052,067 to Nuxoll, U.S. Pat. No. 6,448,905 to Jones and U.S. Pat. No. 5,959,554 to Armstrong. None of these devices, however, are available in the marketplace nor, based upon research, have ever been readily available in the marketplace.

Several drawbacks exist with the remote control traffic control devices referenced above. First, traffic control devices that are set on timers or are otherwise automatically or computer controlled to direct traffic are inefficient and undesirable in most situations because of the unpredictability of motorists. If, for example a motorist fails to stop even though a traffic sign displays a STOP signal, a traffic accident, or impact with workers, is likely. It is beneficial and important for humans to control traffic signals in the circumstances described so that a reactionary decision can be made responsive to the actions of motorists. Accordingly, it is important for human control to be in place rather than relying upon any type of automated traffic control device.

Second, many of the devices disclosed are not durable enough for sustained or long-term use. It is important for all the components of a device to be housed from the weather and protected, as much as possible, from contact from passing vehicles.

Third, a remote controlled traffic signal must be brightly colored and highly visible so that motorists are quickly aware that attention is necessary when they first sight the device. Next, the device must be easy to operate, have as few moving parts as possible and have a high level of dependability for long-term and sustained operation.

Finally, the device must be safe for use, not only by the traffic control personnel but also by passing motorists. Not only do motorists strike traffic control personnel but they are prone to striking signs, signaling devices, barricades and the like. Accordingly, for this device to be useful in the workplace, it must meet or exceed established crash tests and impact standards.

None of the devices disclosed in the referenced patents meet all of these criteria.

Safety Standards

Work zone traffic control devices are used in work zones to regulate, warn and guide motorist and to advise them to traverse a section of highway or street in a proper manner. The Federal Highway Administration requires all installations of work zone traffic control devices used on any national highway system to have been safety tested and found acceptable in accordance with the recommendations in the American Association of State Highway and Transportation Officials "Manual for Assessing Safety Hardware" evaluation criteria. The "Manual for Assessing Safety Hardware" specifically addresses the performance requirements of work zone traffic devices. Recommended tests to evaluate work zone traffic control devices performance are defined for two different test levels. Test Level 2 is conducted at nominal impact of 44 miles per hour (70 km per hour). Test Level 3 is conducted at 62 miles per hour (100 km per hour) and is considerably more demanding than the Test Level 2 for lightweight traffic control devices.

The instant invention has been tested by independent and accredited testing services to determine whether the device is safe for use on the national highway system. Specifically, the device was submitted to Test Level 3 by impacting it with a vehicle traveling 62 miles per hour. The device, as later described herein, is symmetrical having a large base tapering to a smaller top portion in a substantially pyramidic shape. Since the device is generally symmetrical and is generally deployed to face oncoming traffic, a zero degree head angle for impact was determined to be critical angle for testing.

The testing requires that the device upon impact with the vehicle activate in a predictable manner by breaking away, fracturing or yielding. Detached elements, fragments or debris from the device cannot penetrate the interior of the vehicle or present undue hazard to other traffic, pedestrians or work personnel in the work zone. Moreover, any detached fragments of the device cannot block driver's vision or otherwise cause the driver to lose control of the vehicle.

Level three testing of the device showed that it readily yielded to the vehicle upon impact in a predictable manner and that there were no detached elements, fragments or other debris from the device that would penetrate or show potential for penetrating the vehicle or otherwise presenting undue hazard to other traffic, pedestrians or personnel in the work zone. Upon testing, none of the debris from the device at impact blocked the driver's vision or otherwise would cause a driver to lose control of the vehicle. Accordingly, the inventive device, as described and claimed herein has been deemed safe for use on national highway systems, a significant departure from the previously disclosed and claimed inventions referenced herein.

SUMMARY OF THE INVENTION

The remote operated safety attendant disclosed herein provides a user friendly, durable, highly visible and safe to use remote controlled traffic control signaling device. The most common method for traffic control workers to control traffic flow patterns at a construction work site, or under similar situations, is to stand on or adjacent to roadway and display a handheld sign to oncoming traffic. The most common signage has STOP displayed on one side and SLOW displayed on the second side. The use of traffic control workers, to date, has been the preferred methodology for controlling traffic flow patterns because of the ability of the worker to quickly make decisions on how to control traffic in direct response to the situation and in response to the actions of motorists. As indicated, however, controlling traffic from the roadway or adjacent to the roadway is very dangerous with a high number of injuries and deaths per year to these traffic control workers.

The instant device includes a substantially pyramidic housing having four faces, a wide base and narrow top. This housing is made of high impact plastic or similar material, and is preferably manufactured in bright colors so that it is easily visible. The housing encloses a remote control signal receiver system, coupled to a motor. The motor controls a shaft and selectively rotates the shaft along a generally rotational pathway. The motor can be provided with electrically controlled stop points so that the shaft is rotated between 0 and 360 degrees, or any limitation therebetween. A paddle sign, preferably a STOP/SLOW sign is attached to the upper most portion of the shaft. Power is supplied by a 12 volt battery or similar source. A STOP/SLOW paddle sign is presented at the top of the housing, connected to the sign shaft. This configuration allows the device to selectively display either side of the paddle sign as controlled by a worker. It is preferred that the device be remotely controlled wherein the motor drive is operably connected to a remote controlled receiver. A separate remote control transmitter has a simple two-way toggle switch that allows a worker to toggle between "SLOW" and "STOP" on the device. It is to be understood the sign may have any indicia displayed depending on the use of the device. For example, for use in a school crossing zone, the device might have STOP on both sides of the sign to stop traffic in two directions while the cross walk is in use. To then allow traffic flow to resume the shaft would rotate 90 degrees so that the display sides of the sign are oriented to the cross walk, signaling pedestrians to stop while motorized traffic flows. The remote control system is preferably a radio frequency or infrared transmitter but can also be wired directly to the signal receiver. Flashing lights, static lights or other warning devices and signals can be placed on the outside surface of the housing.

An optional horn or other audible warning device may be incorporated in the invention so that a warning sounds to motorists as the signal is turned from the "slow" position to the "stop" position.

Because of the unique of the housing, the heavier portions of the invention, namely the motor, the remote signal receiver, the battery and the mechanical components of the device are all positioned near the lower-most surface of the housing. This places the vast majority of the weight below the bumper of most vehicles. Accordingly, when a vehicle impacts the device, the heavy components optimally will go under the vehicle or will be pushed directly forward in front of the vehicle rather than fragmenting into the air where the vehicle occupants, other motorists or nearby workers could be injured. This has been verified through the certified testing described above.

In use, it is preferred that a worker be positioned near the device but away from the roadway so that the worker can visualize traffic patterns and make quick decisions responsive to the environment as to whether to slow or stop oncoming traffic. This allows the benefits of human control of signaling devices while gaining the benefit of a robotic signal device to limit or control the likelihood of injury or even death to workers.

This invention is capable of many other embodiments that are being practiced and carried out in various ways. As such, those skilled in the art will appreciate that the conception, upon which this disclosure is based, may readily be utilized as a basis for the designing of other structures, methods and systems for carrying out the stated purposes of the present invention. It is important, therefore, that the claims be regarded as including equivalent construction insofar as they do not depart from the spirit and scope of the present invention.

DETAILED DESCRIPTION OF THE INVENTION

Figure 1:
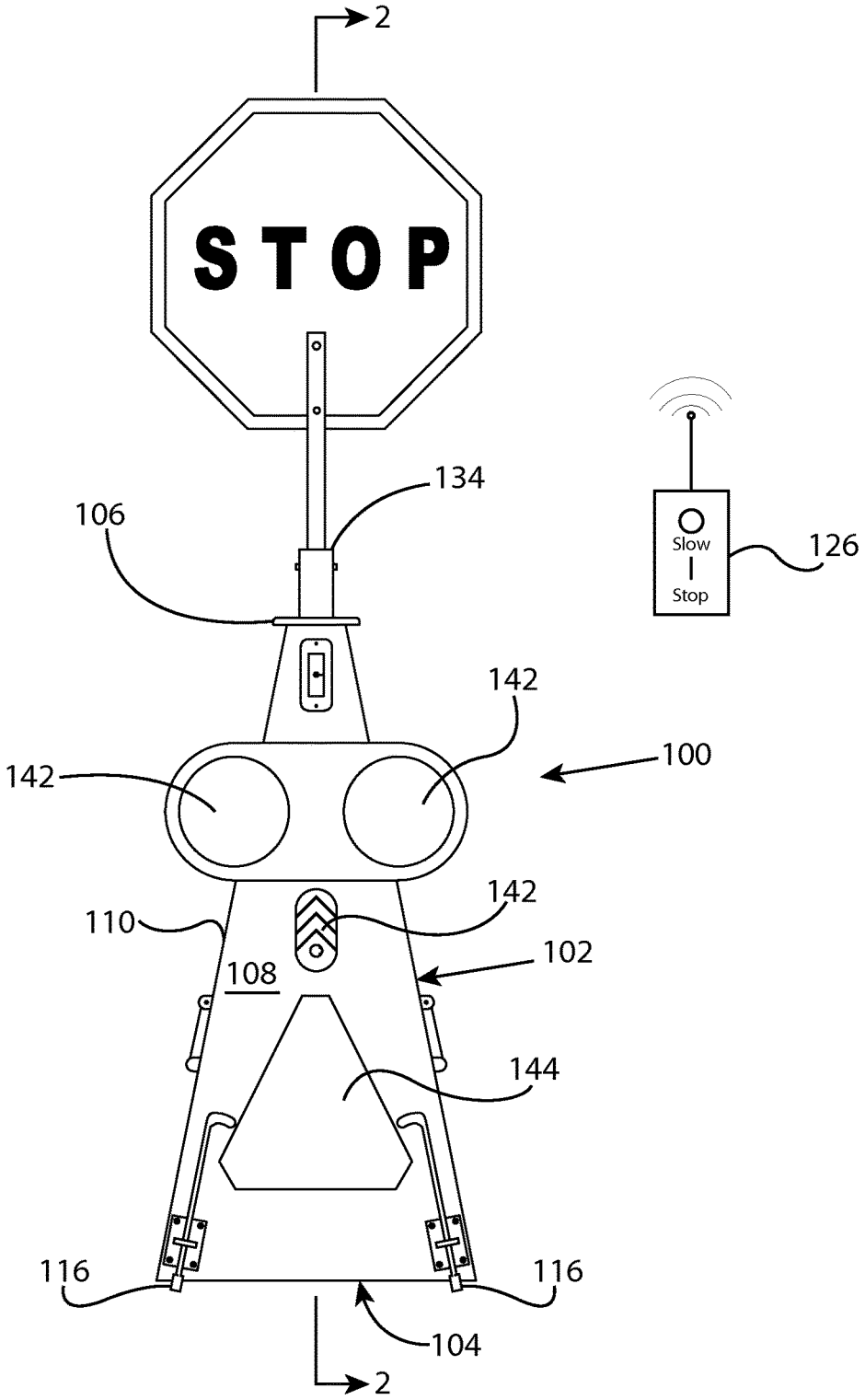
FIG. 1 is a front plan view of one embodiment of the inventive device.

Referring now generally to FIGS. 1 through 4, the inventive device 100 includes a housing 102 that is preferably pyramidic in shape. The housing 102 has a base 104, a spaced-apart top 106 and four sides 108 tapering between the base 104 and top 106. The sides 108 meet at corners 110 that may be beveled or rounded to limit straight or "cutting" edges. The housing 102 might also be provided in a round, or other geometric shape if desired. The preferred shape, however, includes flat or planar sides 108 as shown in the figures due to the specific impact safety imparted by that configuration.

The housing 102 is preferably made of manufactured dense fiber (MDF) but can also be manufactured high impact plastic, fiberglass or resin compound that are easily moldable, can be colored and is durable. It should be apparent that other materials could be used to manufacture the housing 102 but doing so affects the crashworthiness and safety of the device. Moreover, it is preferred that the materials comprising the housing easily fragment upon high impact to quickly reduce the bulk of the device should it become air born upon impact. Through testing, MDF works the best for overall durability, ease of manufacture and by achieving the preferred fragmentation upon impact by a vehicle. The housing 102 shape of the inventive remote operated safety attendant is important because it is anticipated that this device will be struck by inattentive motorists when in use. The pyramidic design places most of the geometrical surfaces and weight of the device below the bumper of a standard motor vehicle. Moreover, the flat surfaces of the preferred embodiment allow a predictable and consistent impact result when the device is struck by a motor vehicle.

The housing 102 is substantially hollow allowing for the placement and containment of the electrical and mechanical components of the device. An access hatch 112 may be provided in one or more of the surfaces of the device. The device may include a plurality of wheels 114 attached to or near the base to allow easy movement of the device which will mostly likely weigh between 175 and 200 pounds. Optional leveling legs 116 may be provided at or near the base 104 of the device to allow the device to be leveled on uneven surfaces.

Figure 2:
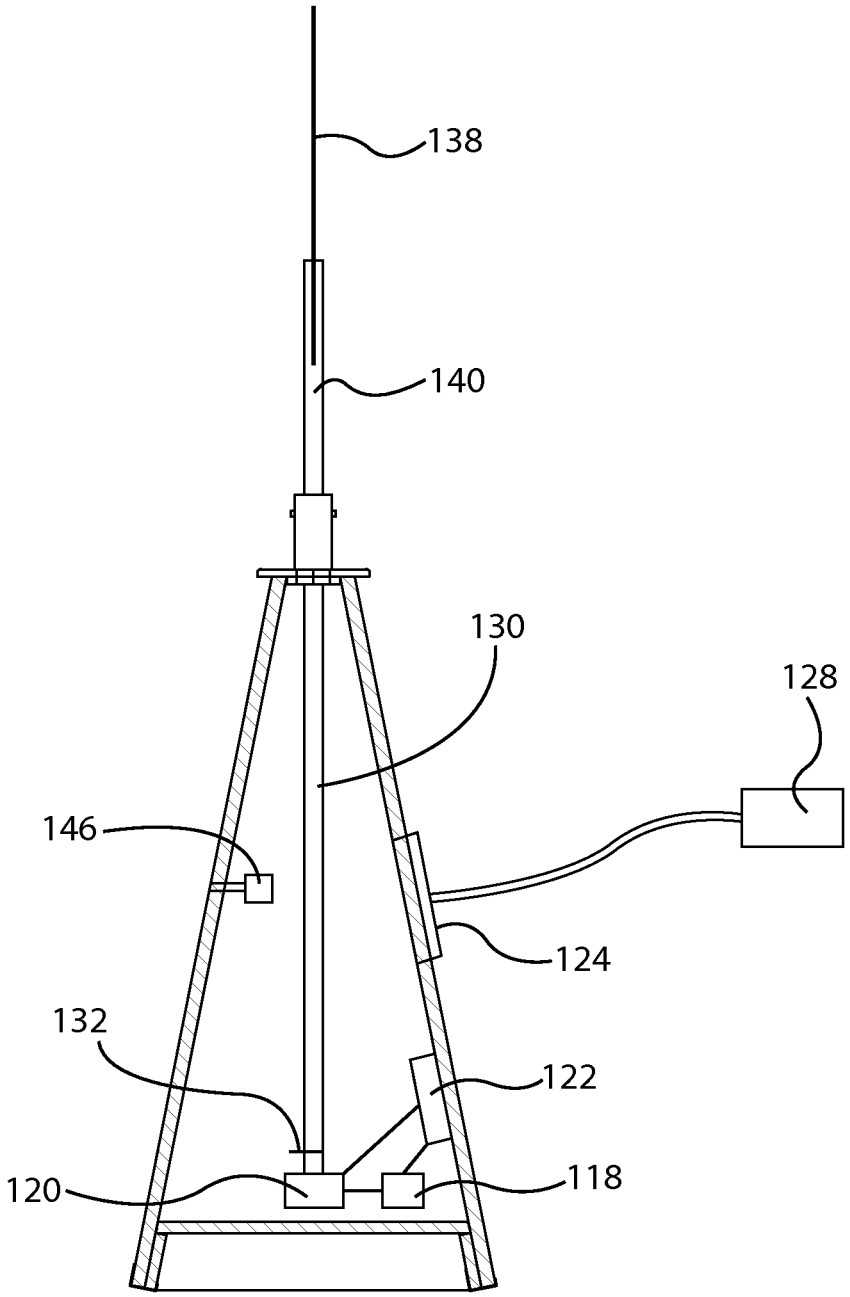
FIG. 2 is a cross-sectional view of one embodiment of the inventive device taken along the line 2-2 of FIG. 1.
Figure 3:
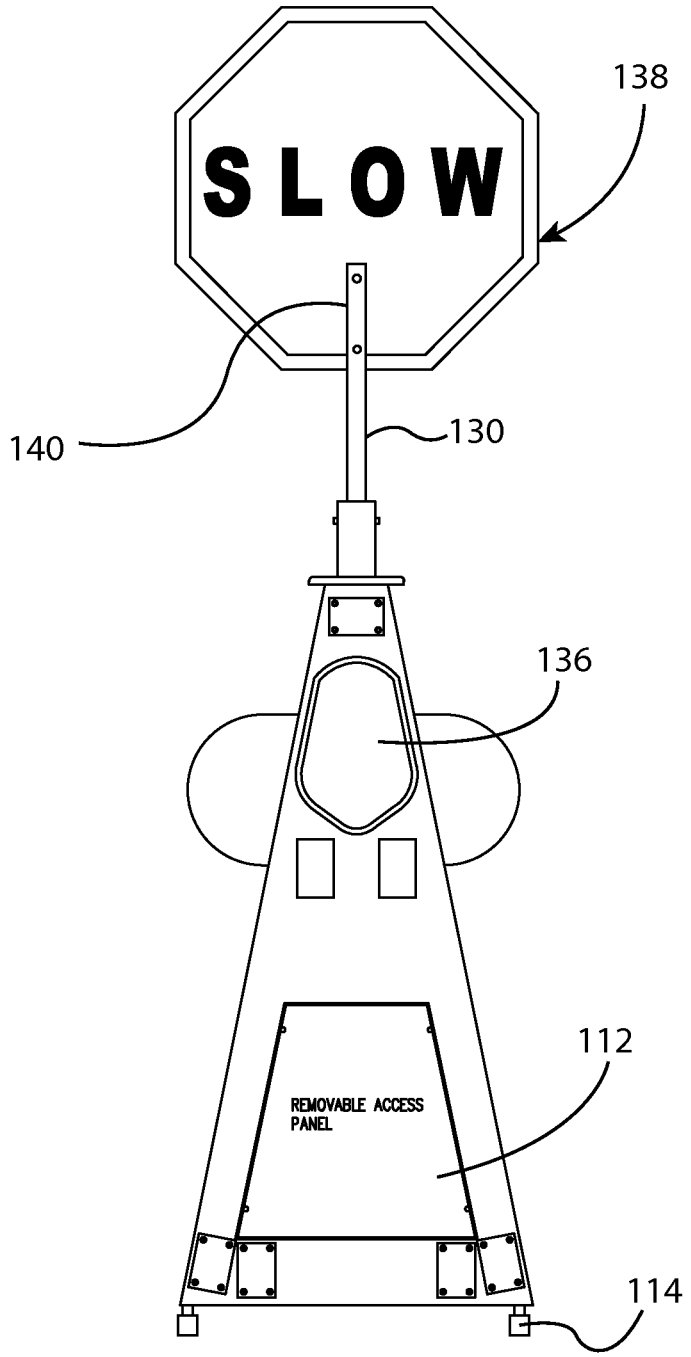
FIG. 3 is a back plan view of one embodiment of the inventive device.
Figure 4:
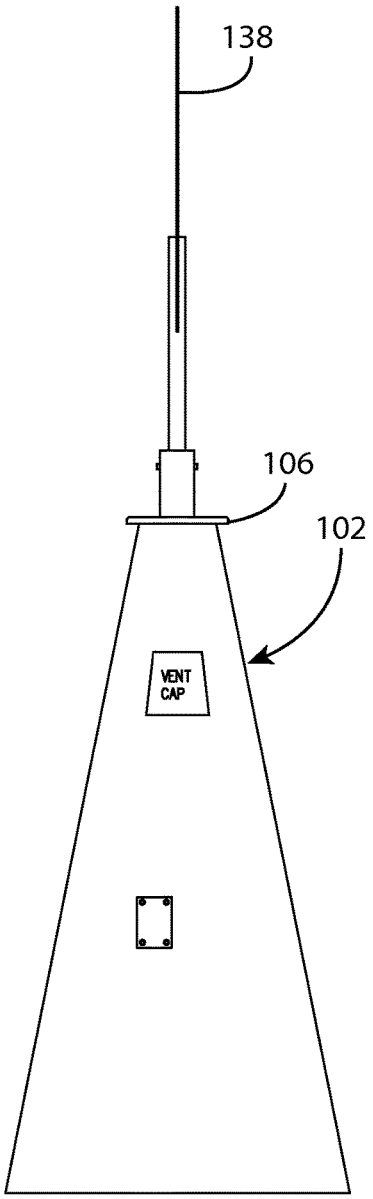
FIG. 4 is a side plan view of one embodiment of the inventive device.
Figure 5:
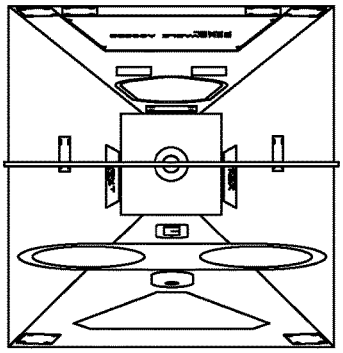
FIG. 5 is a bottom plan view of one embodiment of the inventive device.
Figure 6:
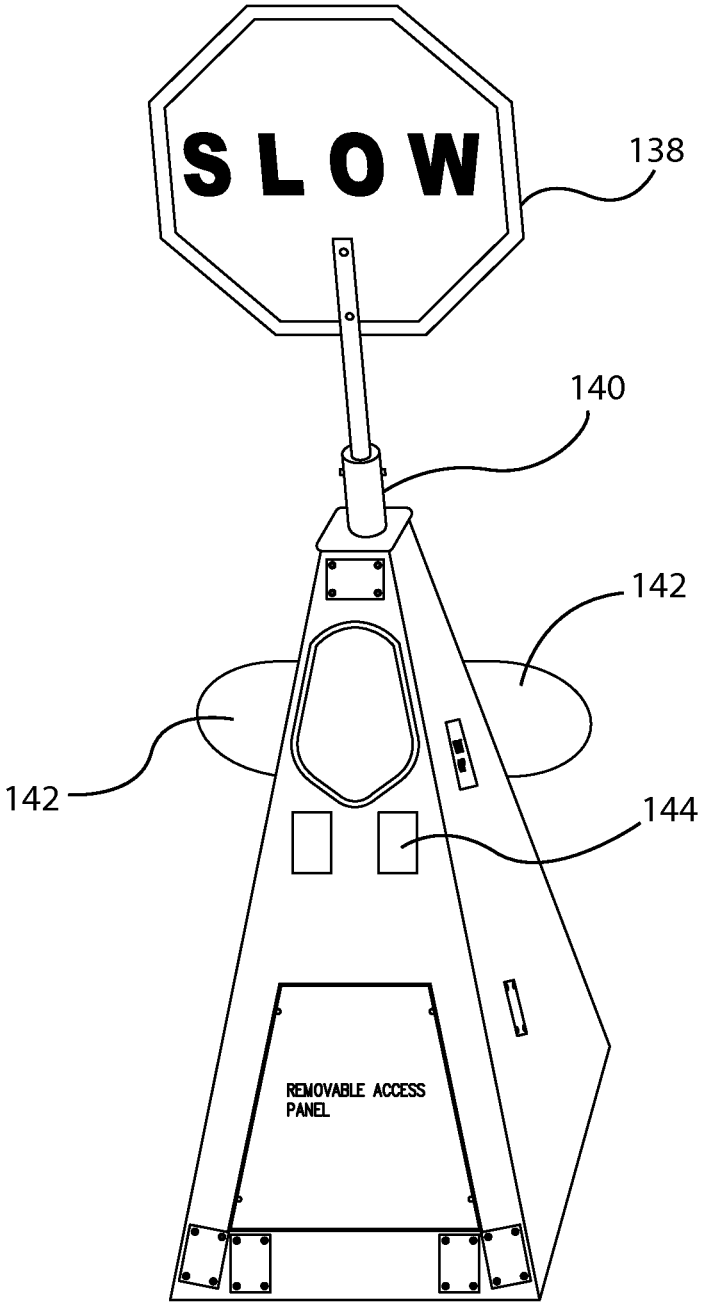
FIG. 6 is a perspective view one embodiment of the inventive device.

As best shown in FIG. 2, the device includes a power source 118 such as a readily available twelve volt battery positioned inside the housing. The power source 118 provides electrical power to a motor 120 and a remote signal receiver system 122. The preferred motor 120 is a simple 12 volt gear drive, low RPM motor. The remote signal receiver system 122 is known in the industry and may be configured to receive radio frequency signals, infrared signals a remote control signal sending device 126 or direct electrical signals from an optional wired connector 128. While it is preferred that the device 100 is remote controlled, an electrical connector 124 is provided with the device so that a control box 126 can be directly wired in to the signal receiver 122. The remote signal receiver 122 is electrically connected to the motor 120 to signal the motor 120 to actuate. A preferred source for the remote signal receiver 122 and transmitter 126 is Linx Technologies of Merlin, Oreg., although similar devices are readily available from a variety of manufacturers.

The motor 120 can be either a linear drive motor or a rotational motor depending upon the preferred configuration of the device. The motor 120 selected is connected to a sign shaft 130 oriented generally upward through the middle of the housing 102 through an opening (not shown) in the top 106. A first end 132 of the shaft 130 is connected to the motor 120. When signaled, the motor 120 moves to rotate the shaft 130 between 0 and 360 degrees to orient the shaft in a predetermined orientation. If a rotational motor, the motor 120 can be configured to rotate the shaft 180 degrees upon each actuation or can be a forward/reverse motor so that the shaft 130 turns 180 degrees upon a first actuation of the motor 120 and then reverses direction upon a second actuation of the motor 120. The motor 120 can be provided with electrically controlled stops so that the motor rotates a predetermined path between 0 and 360 degrees. For linear motors the motor 120 utilizes a push/pull assembly to rotate the shaft 130 approximately 180 degrees upon a first actuation and then return the shaft 180 degrees for the second actuation, as is known in the industry.

An optional connection port 136 may be provided through the housing 102 which includes electrical plug assemblies so that two or more of the devices can be connected by electrical wire and controlled by a single remote control unit.

A two sided paddle sign 138 is fastened to a second end 140 of the sign shaft 130. It is preferable that the sign is a stop/slow sign common in the traffic control industry.

A remote control transmitter 126 is utilized by a traffic worker to control the device 102. The transmitter 126 is a common dual switch remote transmitter that allows a worker to select between two positions. A first position on the remote control transmitter signals the remote control signal receiver 122 which in turn controls the motor 120 which in turn rotates the sign shaft 130 approximately 180 degrees to selectively display either the STOP or the SLOW display side of the paddle. The second position on the remote control transmitter 126 signals the remote signal receiver 122 within the device 102 to actuate the motor 120 approximately 180 degrees to rotate the attached paddle sign 138 so that the opposing display is presented. The control may include a toggle, a push button or any other switch commonly used to selectively actuate a device. The remote control transmitter 126 may optionally include an on/off switch which remotely signals the receiver to selectively start up or power down the device. For example, for use in a school crossing zone, the device might have STOP on both sides of the sign to stop traffic in two directions while the cross walk is in use. To then allow traffic flow to resume the shaft would rotate 90 degrees so that the display sides of the sign are oriented to the cross walk, signaling pedestrians to stop while motorized traffic flows.

In another embodiment of the invention, a plurality of lights 142 can be molded in to one or more sides of the housing 102 or can be attached directly to the device with screws, bolts or other securing devices. The lights 142 are controlled from the power supply 118. Any variety of lights 142 can be selected including LED lights, incandescent lighting, static lights or flashing lights to increase the visibility of the device 100. Any number of reflective signs 144 can also be applied to the outer surface of the housing to signal motorists.

In yet another embodiment of the invention, a video camera 146 may be positioned within the housing 102 or attachable on the outer surface 108 of the housing 102 oriented generally in the forward-facing direction of the device so that the camera 146 can capture oncoming vehicles. The camera 146 would be useful in situations where it is desirable to capture identifying information, such as the make, model, color and license plate number of vehicles that fail to obey the displayed sign 138. Another important use of this camera laden device is in police enforcement or military settings. For example, one of the devices could be used at a checkpoint on a military base. The remote control allows the operator to stand several hundred feet away from the device as a vehicle approaches. The operator can also find protection in a remote enclosure or ballistically protected building as is common on many military establishments. The user of the device can then visualize the vehicle when it comes to a stop, take a closer inspection of the vehicle using the provided camera and access the danger the vehicle and its occupants might present before approaching the vehicle.

What is claimed is:

1. A remote operated safety attendant comprising:

a pyramidal frustum housing having a base for engaging the ground, four sides connected to the base and a top connected to all four sides opposite the base, the top provided with an opening;

a plurality of reflective surfaces connected to the housing;

a remote signal receiver attached to the housing;

a power source within the housing providing power to the remote signal receiver;

a motor within the housing;

a camera located on at least one of the four sides of the housing;

a sign shaft connected to the motor and oriented generally upward through the opening in the top of the housing;

a two sided paddle sign fixed to an upper end of the sign shaft;

a remote control transmitter physically separated from the housing and configured to communicate with the remote signal receiver, the remote signal receiver communicating with the motor to rotate the associated shaft and two sided paddle sign to a predetermined orientation; and an electrical connector attached to the remote signal receiver for connecting multiple remote operated safety attendants;

and wherein remote control transmitter is in communication with at least one remote signal receivers.

2. The remote operated safety attendant of claim 1 wherein the housing is manufactured from a material selected from the group consisting of: manufactured dense fiber, plastic, fiberglass and resin.

3. The remote operated safety attendant of claim 1 wherein the device meets the safety test requirements of the American Association of State Highway and Transportation official's evaluation criteria for test level 3.

4. The remote operated safety attendant of claim 1 further comprising a plurality of lights fastened to the housing.

5. The remote operated safety attendant of claim 1, further comprising at least two adjustable leveling legs located on at least one of the four sides to allow for the device to be leveled on uneven surfaces.

6. The remote operated safety attendant of claim 1, further comprising a removable access panel located on at least one of the four sides.

7. A remote operated safety attendant comprising:

a pyramidal frustum housing having a base, and a spaced apart top, four sides connecting the base and the top; the top provided with an opening;

a plurality of reflective surfaces connected to the housing;

a remote signal receiver attached to the housing;

at least one light connected to at least one side of the housing a power source within the housing providing power to the remote signal receiver;

a motor attached to the housing;

an access panel in the housing for accessing internal components;

a camera located on at least one of the four sides of the housing;

a sign shaft connected to the motor and oriented generally upward through the opening in the top of the housing;

a two sided paddle sign fixed to an upper end of the sign shaft;

a remote control transmitter physically separated from the housing and configured to communicate with the remote signal receiver, the remote signal receiver communicating with the motor to rotate the associated shaft and two sided paddle sign to a predetermined orientation; and wherein the remote control transmitter is in communication with at least one remote signal receiver.

8. The remote operated safety attendant of claim 7 wherein the at least one light connected to the housing is wider than the side of the housing to which it is connected.

* * * * *